US007721534B2

(12) United States Patent
Sato et al.

(10) Patent No.: US 7,721,534 B2
(45) Date of Patent: May 25, 2010

(54) CONTROL METHOD FOR AN EXHAUST GAS PURIFICATION SYSTEM AND AN EXHAUST GAS PURIFICATION SYSTEM

(75) Inventors: Hitoshi Sato, Fujisawa (JP); Nobuyuki Hiraki, Fujisawa (JP); Takehito Imai, Fujisawa (JP)

(73) Assignee: Isuzu Motors Limited, Shinagawa (JP)

( * ) Notice: Subject to any disclaimer, the term of this patent is extended or adjusted under 35 U.S.C. 154(b) by 1001 days.

(21) Appl. No.: 11/078,487

(22) Filed: Mar. 14, 2005

(65) Prior Publication Data

US 2005/0217251 A1 Oct. 6, 2005

(30) Foreign Application Priority Data

Mar. 31, 2004 (JP) ..... 2004-102305

(51) Int. Cl.
*F01N 3/00* (2006.01)

(52) U.S. Cl. ..... 60/295; 60/274; 60/297; 60/311

(58) Field of Classification Search ..... 60/295, 60/297, 311, 274, 285, 286
See application file for complete search history.

(56) References Cited

U.S. PATENT DOCUMENTS 5,595,580 A * 1/1997 Kawamura ..... 55/288
5,845,486 A 12/1998 Yamashita
6,357,225 B1 * 3/2002 Tanaka ..... 60/277
6,843,054 B2 * 1/2005 Taylor et al. ..... 60/275
6,865,883 B2 * 3/2005 Gomulka ..... 60/295
6,966,179 B2 * 11/2005 Onodera et al. ..... 60/295
7,062,906 B2 * 6/2006 Otake et al. ..... 60/295
2004/0231323 A1 * 11/2004 Fujita et al. ..... 60/284

FOREIGN PATENT DOCUMENTS

| | | |
|---|---|---|
| EP | 1 512 860 | 3/2005 |
| JP | 58 158348 | 9/1983 |
| JP | 2002-276340 | 9/2002 |
| JP | 2003-286887 | 10/2003 |
| JP | 2005-036726 | 2/2005 |

OTHER PUBLICATIONS

European Search Report issued Jan. 23, 2007 in corresponding European patent application No. 05 10 2134.
Japanese Office Action issued Apr. 30, 2008 in corresponding Japanese Patent Application No. 2004-102305.

* cited by examiner

*Primary Examiner*—Thomas E Denion
*Assistant Examiner*—Diem Tran

(57) ABSTRACT

An exhaust gas control system (1) comprised with a continuous regeneration-type DPF (13), an exhaust throttle valve (16) and a DPF control means (30C), wherein the regeneration control is suspended, the multi injection control is performed, and the exhaust throttle valve is closed, when detecting a-stop condition of the vehicle during the regeneration control of the continuous regeneration-type diesel particulate filter device (13) by the regeneration means. Thereby, concerning the regeneration of the continuous regeneration-type DPF device (13), the DPF can be regenerated securely by burning PM efficiently even in a traveling pattern of frequent waiting for the traffic lights to change in urban areas.

6 Claims, 3 Drawing Sheets

CONTROL METHOD FOR AN EXHAUST GAS PURIFICATION SYSTEM AND AN EXHAUST GAS PURIFICATION SYSTEM

BACKGROUND OF THE INVENTION

The present invention relates to an exhaust gas purification system that purifies particulate matters (hereinafter "PM") from the exhaust gas discharged by diesel and other internal combustion engines using a continuous regeneration-type diesel particulate filter (hereinafter "DPF").

In the same way as for NOx, CO, and also HC etc., restrictions on the volume of PM discharged from internal combustion engines such as diesel engines grow severe every year. Techniques for collecting this PM in a filter known as a DPF and for reducing the quantity thereof by discharging externally have been developed.

DPFs for collecting this PM include a monolithic honeycomb form wall flow type filter made of ceramic, a fiber form type filter made of fiber shape ceramic or metal, and so on. An exhaust gas control system using one of these PDFs are installed on the way of the exhaust passage of an internal combustion engine, similarly to the other exhaust gas control systems, for cleaning exhaust gas generated in the internal combustion engine before discharging the same.

These DPF devices include a continuous regeneration-type DPF device wherein an oxidation catalyst is installed upstream of the DPF, a continuous regeneration-type DPF device wherein the PM combustion temperature is lowered by the effect of a catalyst supported on a filter with catalyst and PM is burned by the exhaust gas, etc.

The continuous regeneration-type DPF device wherein the oxidation catalyst is installed upstream of the DPF uses the fact that the oxidation of PM by $NO_2$ (nitrogen dioxide) is executed at a lower temperature than the temperature at which the oxidation by oxidizing PM with oxygen in the exhaust gas is executed. This DPF device is composed of an oxidation catalyst and a filter. NO (nitrogen monoxide) in the exhaust gas is oxidized to $NO_2$, by an oxidation catalyst supporting platinum or the like on the upstream side. PM collected by the filter on the downstream side is oxidized by this $NO_2$ to $CO_2$ (carbon dioxide). Thereby, PM is removed.

Besides, the continuous regeneration-type DPF device of filter with catalyst is composed of a filter with catalyst such as cerium oxide ($CeO_2$). In this DPF device, PM is oxidized by a reaction ($4CeO_2+C \rightarrow 2Ce_2O_3+CO_2$, $2Ce_2O_3+O_2 \rightarrow 4CeO_2$, etc.) using $O_2$ (oxygen) in the exhaust gas by means of the filter with catalyst, within the low temperature range (on the order of 300° C. to 600° C.). On the other hand, PM is oxidized by $O_2$ (oxygen) in the exhaust gas, within the high temperature range (equal or superior to the order of 600° C.) which is higher than the temperature where PM is burned with $O_2$ in the exhaust gas.

In this continuous regeneration-type DPF device of filter with catalyst, the oxidation catalyst is also installed on the upstream side. The installation of this oxide catalyst raises the exhaust gas temperature, through oxidation reaction of unburned HC and CO in the exhaust gas, and stimulates oxidation and removal of PM. At the same time, this oxidation reaction prevents the emission of unburned HC and CO into the atmosphere.

However, these continuous regeneration-type DPF devices also cause the problem of exhaust pressure rise by the clogging of this filter. In other words, when the exhaust gas temperature is equal or superior to 350° C., PM collected by this DPF is burned continuously and cleaned, and the DPF regenerates itself. However, in case of low exhaust gas temperature and in an operating condition of an internal combustion engine where the emission of NO is low, for example, in case where the low exhaust gas temperature state such as idling of internal combustion engine, low load/low speed operation continues, the oxidation reaction is not stimulated as the exhaust gas temperature is low, the catalyst temperature lowers and the catalyst is not activated and, moreover, NO lacks. Consequently, the aforementioned reaction does not occur and the filter can not be regenerated through oxidation of PM. As a result, PM continues to deposit in the filter and the filter clogging progresses.

As a measure against this filter clogging, it has been conceived to forcibly burn and remove the collected PM by forcibly raising the exhaust gas temperature, when the amount of clogging has exceeded a predetermined amount. As for means for detecting the filter clogging, there are some methods such as a method for detecting by the differential pressure across the filter, and a method for detecting through judgment of the PM accumulation quantity by calculating the quantity of PM collected from the engine operation state from a predetermined map data. Besides, as means for exhaust gas temperature raising, there is a method by injection control of the injection in the cylinder, or a method by fuel control in the direct fuel injection in the exhaust pipe.

The cylinder injection control executes an auxiliary injection after a main injection at a timing delayed from a normal burn so as to continue the burn at a delayed timing, in the case where the exhaust gas temperature is lower than the active temperature of an oxidation catalyst disposed upstream of the filter or supported on the filter. The exhaust gas is heated by executing so-called multi injection (multi-stage injection) to the temperature higher than the active temperature to execute a post injection (posterior injection) and then the fuel in the exhaust gas is burned by the catalytic reaction of the oxidation catalyst. Thereby the filter is regenerated by burning and removing collected PM after raising the exhaust gas temperature higher than a temperature the PM collected in the filter can be burned.

Normally with continuous regeneration-type DPF devices, as disclosed in Japanese patent application Kokai publication No. 2002-276340 and Japanese patent application Kokai publication No. 2003-286887, for example, when the collected quantity of PM reaches a preset limit, the traveling condition is automatically changed to regeneration mode and the collected PM is oxidized and removed by forcibly raising the exhaust gas temperature or increasing the quantity of NOx. And thereby, the filter is regenerated.

In the case where traveling patterns with a high exhaust gas temperature are generally frequent, such as the case in traveling on expressways is the main purpose of the user, an uneven accumulation of PM which does not appear as a differential pressure of the DPF device is developed at the periphery of the filter. Therefore, another method is conceived which forcibly burn the PM during traveling by supplying a traveling distance into a regeneration starting condition.

Nevertheless, in terms of actual traveling conditions, in particular, in such a place like an urban area, traveling and stopping are frequently repeated because of traffic signals and the like. Therefore the repetition makes internal combustion engine load varies between traveling condition and stationary idling condition in a complicated manner and the exhaust gas temperature which is important for the DPF regeneration control varies also in a complicated manner. For this reason, it is possible dependent on traveling patterns that DPF regenerating control will not terminate within the preset time or the exhaust gas temperature is not raised sufficiently. Therefore it arises a problem that the collected PM is not be burned and removed sufficiently.

BRIEF SUMMARY OF THE INVENTION

The purpose of the present invention is to provide a control method for an exhaust gas purification system and an exhaust gas purification system provided with a continuous regeneration-type DPF device in which DPF is securely regenerated by efficiently burning PM even in a traveling pattern with frequent stops for traffic lights and the like in an urban area.

For achieving the above-described purpose, the control method for an exhaust gas purifying system according to the present invention is comprised with a continuous regeneration-type diesel particulate filter (DPF) device and an exhaust throttle valve in an exhaust gas passage thereof, composed to comprise a DPF control means having a regeneration timing judgment means for judging the regeneration start timing of the continuous regeneration-type DPF device and a regeneration means for regenerating the continuous regeneration-type DPF device by forcibly burning collected particulate matters by raising the exhaust gas temperature; characterized in that the regeneration control is suspended, the multi-injection control is performed, and the exhaust throttle valve is closed, when detecting a stop condition of the vehicle during the regeneration control of the continuous regeneration-type DPF device by the regeneration means.

And, the control method of exhaust gas purification system described above is also characterized in that the regeneration control is resumed, when detecting restarted moving of the vehicle, during the execution of the regeneration control is suspended.

Further, for achieving the purpose describe above according to the present invention, the control method of exhaust gas purification system, in an internal combustion engine mounted on a vehicle provided with a continuous regeneration-type DPF device and an exhaust throttle valve in an exhaust gas passage thereof, composed to comprise a DPF control means having a regeneration timing judgment means for judging the regeneration start timing of said continuous regeneration-type DPF device and a regeneration means for regenerating the continuous regeneration-type DPF device by forcibly burning collected particulate matters by raising the exhaust gas temperature; characterized in that the system further comprises a vehicle traveling condition detection means and, suspends the regeneration control, performs the multi injection control, and closes the exhaust throttle valve, when detecting a stop condition of the vehicle by the vehicle traveling condition detection means during the regeneration control of the continuous regeneration-type DPF device by the regeneration means of the DPF control means.

In supply, the above-described exhaust gas purification system is further characterized in that the DPF control means resumes the regeneration control, when detecting a restarted moving of the vehicle by the vehicle traveling condition detection means, during the regeneration control is suspended.

Namely, when a vehicle is stopped with keeping the regeneration control which has been started automatically during the traveling of the vehicle, it is so composed not to completely stop the regeneration control but to perform the multi injection control and the exhaust throttle control in the fuel injection control in the cylinder, temporarily suspending the unburned fuel supply control such as a post injection control of the fuel injection control in the cylinder and a control of direct fuel injection in the exhaust pipe.

In the case where the vehicle starts moving and shifts to a traveling condition from such condition where the exhaust gas temperature and the continuous regeneration-type DPF device are kept hot, the unburned fuel supply control can be executed immediately and PM can be burned and removed since the exhaust gas temperature has been keeping at hot condition such as in traveling regeneration. Consequently, PM deposited in the DPF can be burned efficiently and securely.

Moreover, the regeneration control is so composed to perform a so-called multi-injection control to raise the exhaust gas temperature and the unburned fuel supply control for supplying unburned fuel into the exhaust gas flowing in the continuous regeneration-type diesel particulate filter device by the regeneration means in the diesel particulate filter control means, for instance, in an operation state where the temperature of DPF lowers, when it is judged to be the timing of a regeneration by the regeneration timing judgment means.

Besides, the continuous regeneration-type DPF device of the above-described exhaust gas purification system can be realized in the form of a continuous regeneration-type DPF device supporting an oxidation catalyst in the filter, a continuous regeneration-type DPF device providing an oxidation catalyst on the upstream side of the filter, or a continuous regeneration-type DPF device providing an oxidation catalyst on the upstream side of the filter while also supporting a catalyst in the filter, etc.

According to the control method of exhaust gas purifying system and the exhaust gas purifying device of the present invention, it is possible to keep the exhaust gas at a high temperature and to retain the temperature of the continuous regeneration-type DPF device during a stop condition of the vehicle, by closing an exhaust throttle valve of an exhaust-brake or an exhaust throttle executing an exhaust gas temperature raising control of a cylinder fuel injection such as a multi injection control, in the case where the vehicle stops to shift its traveling condition to an idling condition during the regeneration control in traveling condition.

Therefore, it is possible to burn PM efficiently when the stop condition shifts to traveling condition and the regeneration control is resumed, since the temperature of the exhaust gas and the continuous regeneration-type DPF device is kept high even at the start of traveling.

Thereby, it is possible to burn PM securely even in a traveling pattern with frequent stops for traffic lights and the like in urban areas.

DETAILED DESCRIPTION OF THE INVENTION

Hereinafter, the preferred embodiments of the control method for an exhaust gas purification system and the exhaust gas purification system according to the present invention will be described with reference to the accompanying drawings. The following explanation will use the example of an exhaust gas purification system provided with a continuous regeneration-type diesel particulate filter (DPF) device comprising a combination of an oxidation catalyst and a filter with catalyst.

Figure 1:
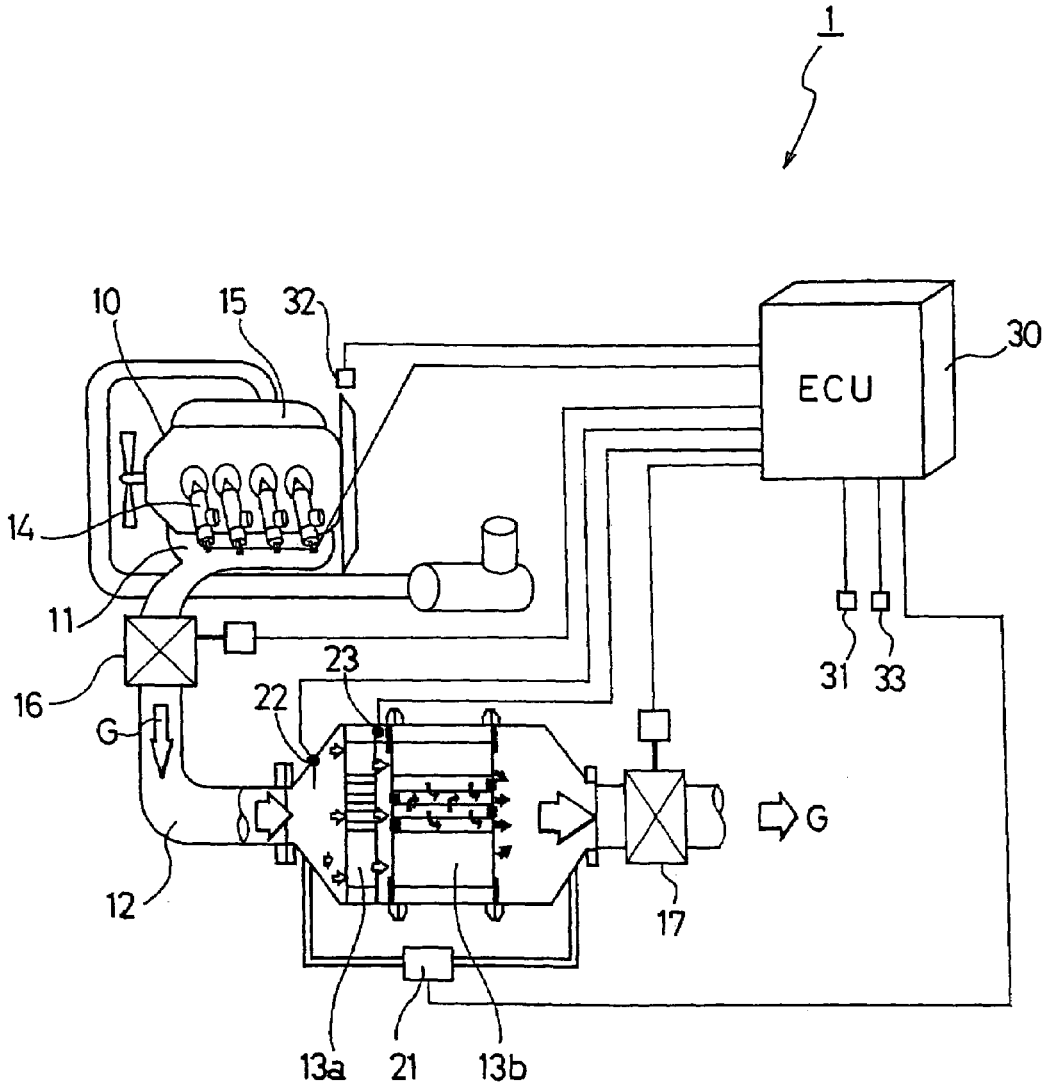
FIG. 1 is a systematic block diagram of the exhaust gas purification system according to an embodiment of the present invention.

FIG. 1 shows the configuration of an exhaust gas purification system 1 for an internal combustion engine according to an embodiment of the present invention. This exhaust gas purification system 1 is configured to provide a continuous regeneration-type DPF device 13 on an exhaust passage 12 connected to an exhaust manifold 11 of a diesel engine 10. This continuous regeneration-type DPF device 13 is configured with an oxidation catalyst (DOC) 13*a* on the upstream side thereof and a filter with catalyst (CSF) 13*b* on the downstream side thereof.

The oxidation catalyst 13*a* is formed so as to support an oxidation catalyst of platinum (Pt) etc. on a support with a ceramic honeycomb structure etc. The filter with catalyst 13*b* is formed of a monolithic honeycomb wall flow type filter with entrances and exits to channels in a porous ceramic honeycomb alternately closed or a felt-type filter with randomly layered alumina other inorganic fibers or the like etc. A platinum or calcium oxide etc. catalyst is supported on this filter portion.

In cases where a monolithic honeycomb wall flow type filter is used as the filter with catalyst 13*b*, the PM contained in the exhaust gas is collected (trapped) in the porous ceramic walls. When a fabric type filter type is used, PM is collected in the inorganic fibers thereof.

A differential pressure sensor 21 is provided on the conduit tube in front of and behind the continuous regeneration-type DPF device 13 in order to estimate the collecting quantity of PM on the filter with catalyst 13*b*. For the purpose of regeneration control of the filter with catalyst 13*b*, furthermore, an oxidation catalyst inlet exhaust gas temperature sensor 22 and a filter inlet exhaust gas temperature sensor 23 are provided upstream of and between the oxidation catalyst 13*a* and the filter with catalyst 13*b* respectively.

The output values from these sensors are input to an engine control unit (ECU) 30. In supply to controlling the overall operation of the engine 10, the engine control unit 30 also performs regeneration control of the operation of the continuous regeneration-type DPF device 13. The fuel injection devices (i.e., injection nozzles) 14 of the engine 10, exhaust throttle valve 16 (or 17) and an ECR valve disposed on an EGR passage (not shown) together with an EGR cooler are controlled in accordance with the control signals output from this engine control unit 30. As the exhaust throttle valve, FIG. 1 shows both of the exhaust brake 16 disposed on the upstream side and the exhaust throttle 17 disposed on the downstream side of the continuous regeneration-type DPF device 13 respectively, but either one of them actuates as the throttle valve in this control operation.

These fuel injection devices 14 are connected to a common-rail fuel injection system (not shown) storing temporarily the fuel pressurized by the fuel pump (not shown) to high pressure. In order to drive the engine, the accelerator opening from the accelerator position sensor (APS) 31 and the engine speed from the engine speed sensor 32 and the vehicle speed from vehicle sensor 33 etc. are input into the engine control unit 30 together with other data such as the vehicle speed and cooling water temperature.

Figure 2:
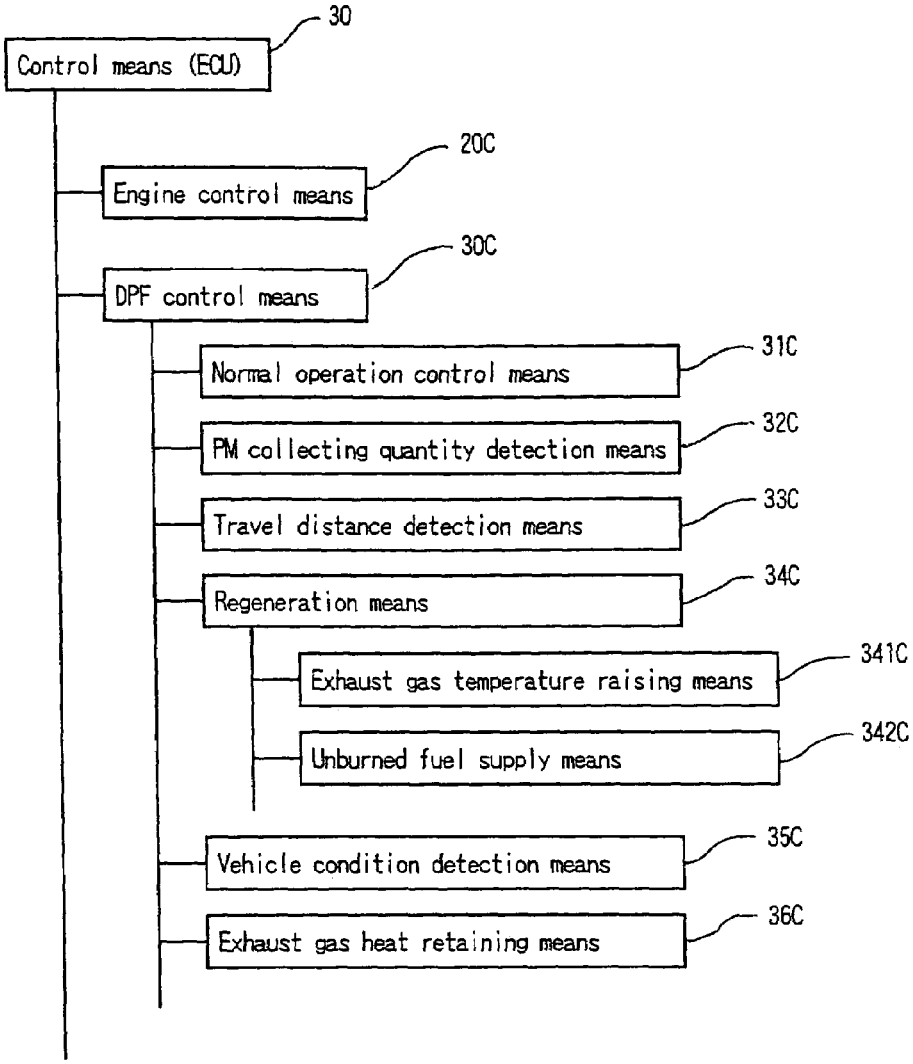
FIG. 2 is a drawing showing the control means configuration for the exhaust gas purification system according to an embodiment of the present invention.

As shown in FIG. 2, the control device 30 according to the present invention comprises an engine control means 20C controlling driving of the engine and a diesel particulate filter (DPF) control means 30C for the exhaust gas purification system 1 etc. The DPF control means 30C comprises a normal operation control means 31C, a PM collecting quantity detection means 32C, a travel distance detection means 33C, a regeneration means 34C, a vehicle condition detection means 35C, an exhaust gas heat retaining means 36C etc.

The normal operation control means 31C is in particular a means for performing normal operating unrelated to regeneration of the continuous regeneration-type DPF device 13. In this normal operation control means 31C, normal injection control is carried out wherein a predetermined volume of fuel is injected from the fuel injection devices 14 in accordance with an electric current time signal calculated in the control device 30 based on signal from the accelerator position sensor 31 and signal from the engine speed sensor 32.

The PM collecting quantity detection means 32C is a means for detecting the PM collecting quantity ΔPm accumulated in the filter with catalyst 13*b* of the continuous regeneration-type DPF device 13. Detection of this collecting quantity ΔPm is carried out using the cumulative calculated value of the collecting quantity estimated from the engine speed and load, the engine rotating accumulated time, and the pressure difference before and after the continuous regeneration-type DPF device 13 etc. In this embodiment, detection thereof is carried out based on the differential pressure before and after the continuous regeneration-type DPF device 13—that is, the measurement values from the differential pressure sensor 21.

The travel distance detection means 33C is a means for detecting the travel distance ΔMc traveled by the vehicle after DPF regeneration. In the travel distance detection means 33C, travel distance ΔMc is calculated by the pulse number of the vehicle speed sensor 33, and when the regeneration is carried out, this distance ΔMc is reset at a suitable timing from the start of regeneration to the end thereof.

Although the control varies slightly in accordance with the type of the continuous regeneration-type DPF device 13, the regeneration means 34C comprises an exhaust gas temperature raising means 341C and an unburned fuel supply means 342C. The exhaust gas temperature raising means 341C performs multi injection in an intra-cylinder injection of the engine 10, raising the exhaust gas temperature to the predetermined temperature such as an active temperature of the oxidation catalyst 13*a*. The unburned fuel supply means 342C performs post injection thereafter, supplying unburned fuel to the exhaust gas to be burned using an oxidation catalyst, and the filter inlet exhaust gas temperature detected by the filter inlet exhaust gas temperature sensor 23 is raised, a suitable temperature and environment for PM oxidation and removal is realized. As a result, the PM collected on the filter with catalyst 13*b* is forcibly burned and removed, and the filter with catalyst 13*b* is regenerated. In these controls, it is also possible to use an intake control such as an intake throttle control or/and an EGR control.

The vehicle condition detection means 35C is a means for detecting whether the vehicle is currently in traveling condition or in stationary idling condition. Based on the accelerator opening from the accelerator position sensor 31, the engine speed from the engine speed sensor 32, and the vehicle speed from the vehicle speed sensor 33 etc., the vehicle condition detection means 35C judges whether the vehicle is in traveling condition or stationary idling condition.

Furthermore, the exhaust gas heat retaining means 36C is a means for performing multi injection while throttling the exhaust gas by closing an exhaust throttle value such as an exhaust brake 16 or an exhaust throttle 17 when the vehicle has stopped and shifted to stationary idling condition during regeneration control. Thereby, the heat of the exhaust gas can be retained and prevented from dropping.

The DPF control means 30C having the above-described various means is configured as a means which continues a normal operating by the normal operation control means 31C or automatically actuates regeneration means 34C based on the PM collecting quantity ΔCm detected by the PM collecting quantity detection means 32C.

Now, the regeneration control of this exhaust gas control system 1 shall be described. In the control of this exhaust gas purification system 1, the normal operating is performed by the normal operation control means 31C and PM is collected during the normal operating. In this normal operating, the normal operating enters the regeneration control by the regeneration means 34C, in case where the collection quantity ΔCm of PM collected by the filter with catalyst and detected by the PM collection quantity detection means 32C becomes equal or superior to a predetermined judgment collecting quantity ΔCm0. It should be appreciated that, in this embodiment, it enters the regeneration control by the regeneration means 34C, in case where the measured value ΔPm by the differential pressure sensor 21 becomes equal or superior to a predetermined judgment differential pressure ΔPm0. Then, after the termination of the regeneration control, it returns to the normal operating by the normal operation control means 31C.

Moreover, in order to cope with a traveling pattern where a uneven accumulating of PM which can not be detected by the differential pressure sensor 21, a demand of automatic traveling regeneration is issued and it enters the regeneration control by the regeneration means 34C, even in case where the travel distance ΔMc detected by the travel distance detection means 32C becomes equal or superior to a predetermined judgment distance ΔMi. Then, after the termination of the regeneration control, it returns to the normal operation by the normal operation control means 31C.

Figure 3:
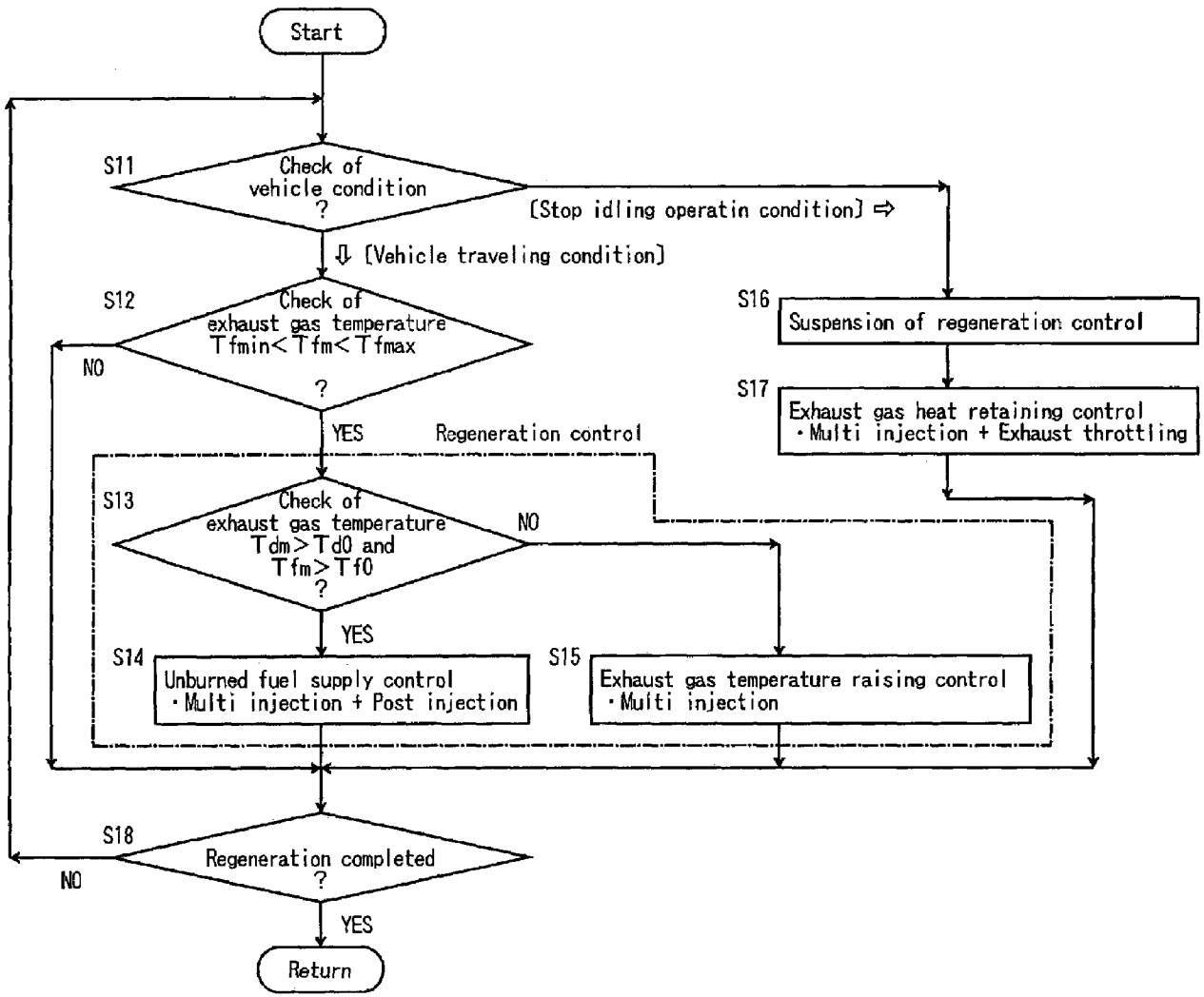
FIG. 3 is a drawing showing the regeneration control flow of the exhaust gas purification system according to an embodiment of the present invention.

And the regeneration control by this regeneration means 34C proceeds according to a control flow as shown in FIG. 3. First, in the check of vehicle condition of Step S11, it is judged if the vehicle operation is in stop idling condition or not by a vehicle condition detection means 35C.

The control flow goes to Step S12 and checks the exhaust gas temperature, when the vehicle is judged to be in a traveling condition, by the judgment of this Step S11. The check of exhaust gas temperature in this Step S12 judges if the temperature Tfm detected at a filter inlet exhaust gas temperature is superior not to a predetermined judgment temperature Tfmin and, at the same time, inferior or not to a predetermined judgment temperature Tfmax. This predetermined judgment temperature Tfmin is for judging if the regeneration is impossible or not at an extremely low temperature, and is equal or inferior to approximately 50° C. to 100° C. On the other hand, the predetermined judgment temperature Tfmax is for judging if PM is regenerated naturally or not at a high temperature and, for instance, is a temperature equal or superior to 600° C.

There, It is judged to be an extremely low temperature phase, or the high temperature phase where the regeneration is automatically performed, in case where the temperature Tfm sensed by the check of the exhaust gas temperature in the Step S12 is equal or inferior to the predetermined judgment temperature Tfmin or equal or superior to the predetermined judgment temperature Tfmax. Then, after a predetermined control time related to the interval of respective checks has elapsed, the control goes to Step S18 without executing the exhaust gas temperature raising control and the unburned fuel supply control. And, in case where it is between the two, it goes to the check of exhaust gas temperature of Step S13.

In the check of the exhaust gas temperature in the Step S13, it is judged if the temperature Tdm sensed by the oxidation catalyst inlet exhaust gas temperature sensor 22 is higher than a predetermined judgment temperature Td0 and, at the same time, if the temperature Tfm detected by the filter inlet exhaust gas temperature sensor 23 is higher than a predetermined judgment temperature Tf0. If one of them is low (in short, in case where the catalyst temperature has not reached the active area), it goes to Step S15, and the exhaust gas temperature raising control by the multi-injection is executed for a predetermined control time related to the interval of respective checks. Thereafter, it goes to Step S18. On the other hand, if both of two are high (in short, in case where the active temperature is attained), it goes to the step S14, and the unburned fuel supply control is performed for a predetermined period of time by the post injection in addition to the multi injection or the direct fuel injection in the exhaust pipe. Thereafter, it goes to Step S18.

If it is judged to be in stop idling condition by the judgment of Step S11, it goes to Step S16 and suspends the regeneration control. Then, in the following Step S17, the multi injection and an exhaust gas heat retaining control is executed for a predetermined period of time, before going to Step S18. In thisn exhaust gas heat retaining control, the valve of the exhaust brake 16 and the exhaust throttle 17 are closed.

In Step S18, it is judged if the regeneration is completed or not by judging if the regeneration control total elapsed time tc became longer than a predetermined judgment time tc1, if the detected differential pressure ΔPm became smaller than a predetermined termination judgment differential pressure value ΔPm1 by the differential pressure sensor 21, and so on. And, if it is judged that the regeneration is to be terminated, it terminates the regeneration and returns. Moreover, in the other case, it returns to Step S11 and repeats Step S11 to Step S18.

According to this control method, the exhaust gas heat retaining control for keeping the exhaust gas temperature is executed by suspending the regeneration control, closing the exhaust throttle valve 16 (or 17) and, furthermore, by executing the multi injection continuously, in the case where the vehicle stops to be shifted to the stop idling condition because of the traffic lights or other reasons in the course of traveling. Therefore, the exhaust gas can be kept hot during the stop idling condition. Consequently, when he vehicle resumes traveling since the exhaust gas temperature can be raised in a short period of time to the temperature where the unburned fuel supply control can be executed, the exhaust gas temperature during the traveling regeneration after restarting the moving can be raised to as high as PM can be burned without delay. Thereby, the continuous regeneration-type DPF device 13 can be regenerated by efficiently burning PM accumulated in the filter with catalyst 13*b*.

The above explanation of a continuous regeneration-type DPF device in the exhaust gas purifying system took a continuous regeneration-type DPF device as an example, which is provided with an oxidation catalyst on the upstream side of the filter and also a catalyst supported on the filter. However, the present invention is not restricted to this embodiment. Furthermore, the continuous regeneration-type DPF device may also be of the type supporting an oxidation catalyst on the filter or provided with an oxidation catalyst on the upstream side of the filter.

What is claimed is:

1. A control method of an exhaust gas purification system, in an internal combustion engine mounted on a vehicle provided with a continuous regeneration-type diesel particulate filter device and an exhaust throttle valve in an exhaust gas passage thereof, composed to comprise a diesel particulate filter control means having a regeneration timing judgment means for judging the regeneration start timing of said continuous regeneration-type diesel particulate filter device and a regeneration means for regenerating the continuous regeneration-type diesel particulate filter device by forcibly burning collected particulate matters by raising the exhaust gas temperature;

wherein the regeneration control is suspended, a multi injection control is performed, and the exhaust throttle valve is closed, when detecting a stop condition of the vehicle during the regeneration control of the continuous regeneration-type diesel particulate filter device by the regeneration means.

2. The control method of exhaust gas purification system of claim 1, wherein the regeneration control is resumed, when detecting restarted moving of the vehicle, during the execution of the regeneration control is suspended.

3. A control method of an exhaust gas purification system, in an internal combustion engine mounted on a vehicle provided with a continuous regeneration-type diesel particulate filter device and an exhaust throttle valve in an exhaust gas passage thereof, composed to comprise a diesel particulate filter control means having a regeneration timing judgment means for judging the regeneration start timing of said continuous regeneration-type diesel particulate filter device and a regeneration means for regenerating the continuous regeneration-type diesel particulate filter device by forcibly burning collected particulate matters by raising the exhaust gas temperature;

wherein the system further comprises a vehicle traveling condition detection means and, at the same time, suspends the regeneration control, performs a multi injection control, and closes the exhaust throttle valve, when detecting a stop condition of the vehicle by the vehicle traveling condition detection means during the regeneration control of the continuous regeneration-type diesel particulate filter device by the regeneration means of the diesel particulate filter control means.

4. The exhaust gas control system of claim 3, wherein the diesel particulate filter control means resumes the regeneration control, when detecting a restarted moving of the vehicle by the vehicle traveling condition detection means, during the execution of the regeneration control is suspended.

5. A control method controlling an exhaust gas purification system in an internal combustion engine mounted on a vehicle provided with a diesel particulate filter controlling regeneration of the diesel particulate filter by forcibly burning collected particulate matters by raising the exhaust gas temperature, the method comprising:

detecting a stop condition of the vehicle during regeneration control of the diesel particulate filter; and suspending regeneration control and performing multi-injection control when the stop condition of the vehicle is detected during regeneration control of the diesel particulate filter.

6. The control method according to claim 5, wherein the vehicle is provided with an exhaust throttle valve and the exhaust throttle valve is closed when the stop condition of the vehicle is detected during regeneration control of the diesel particulate filter.

* * * * *